US012208872B2

(12) United States Patent
Johansen

(10) Patent No.: US 12,208,872 B2
(45) Date of Patent: Jan. 28, 2025

(54) BODY-ENHANCED LIFE JACKET

(71) Applicant: FLOATDEES, LLC, North Ogden, UT (US)

(72) Inventor: Stacy Johansen, North Ogden, UT (US)

( * ) Notice: Subject to any disclaimer, the term of this patent is extended or adjusted under 35 U.S.C. 154(b) by 891 days.

(21) Appl. No.: 17/099,688

(22) Filed: Nov. 16, 2020

(65) Prior Publication Data

US 2021/0147046 A1 May 20, 2021

Related U.S. Application Data

(60) Provisional application No. 62/935,632, filed on Nov. 14, 2019.

(51) Int. Cl.

| | |
|---|---|
| ***B63C 9/115*** | (2006.01) |
| ***A41C 3/00*** | (2006.01) |
| ***A41C 3/02*** | (2006.01) |
| ***A41D 13/012*** | (2006.01) |
| ***A41F 15/00*** | (2006.01) |
| ***B63C 9/11*** | (2006.01) |

(52) U.S. Cl.

CPC ..... *B63C 9/115* (2013.01); *A41C 3/0028* (2013.01); *A41C 3/02* (2013.01); *A41D 13/0125* (2013.01); *A41F 15/002* (2013.01); *B63C 9/11* (2013.01); *A41C 3/0057* (2013.01); *A41D 2400/38* (2013.01)

(58) Field of Classification Search

CPC ..... B63C 9/087; B63C 9/093; B63C 9/11; B63C 9/115; B63C 9/125; B63C 9/1255; A41C 3/0028; A41C 3/0057; A41C 3/02; A41D 7/00; A41D 7/003; A41D 13/012; A41D 13/0125; A41D 13/0518; A41D 2400/38; A41F 15/002

See application file for complete search history.

(56) References Cited

U.S. PATENT DOCUMENTS

| | | | | | |
|---|---|---|---|---|---|
| 3,255,754 | A * | 6/1966 | Brumberger | A41D 7/00 | 450/55 |
| 3,300,797 | A * | 1/1967 | Scheurer | B63C 9/115 | D21/805 |
| D293,960 | S * | 2/1988 | Berenson | A41C 3/08 | D21/805 |
| 4,956,878 | A * | 9/1990 | Boynton | A41D 7/00 | 450/11 |
| 5,119,511 | A * | 6/1992 | Packer | A41D 7/00 | 450/67 |
| 5,678,246 | A * | 10/1997 | Cooley | A41D 7/00 | 2/69 |
| 5,873,767 | A * | 2/1999 | Pickett | A41C 3/08 | 450/91 |
| 6,811,462 | B1 * | 11/2004 | Kenneally | A41C 3/08 | 450/30 |

* cited by examiner

*Primary Examiner* — Ajay Vasudeva
(74) *Attorney, Agent, or Firm* — James Sonntag

(57) ABSTRACT

A body-enhanced life jacket includes a life jacket and an undergarment within the life jacket. The undergarment is configured to shape and provide support for a user's breasts.

20 Claims, 7 Drawing Sheets

BODY-ENHANCED LIFE JACKET

BACKGROUND

Life jackets are used in a water activities to provide life-saving support when needed. They come in different sizes to accommodate different users.

BRIEF DESCRIPTION OF THE DRAWINGS

The accompanying drawings illustrate various implementations of the principles described herein and are a part of the specification. The illustrated implementations are merely examples and do not limit the scope of the claims.

Throughout the drawings, identical reference numbers designate similar, but not necessarily identical, elements.

DETAILED DESCRIPTION

Life jackets are used for a variety of water activities, such as boating, wake surfing, wake boarding, water skiing, jet skiing, tubing, paddle boarding, kayaking, etc. Life jackets may be difficult to find for women with larger breasts, such as 36DD or another average American and UK bra size. There are several reasons that explain why bra sizes have increased over the years. For example, manufacturers have inflated cup sizes. Also, more women have undergone plastic surgery to enhance breasts. Also, breast size has increased with the rising obesity rate due to breasts being largely made up of fatty tissue that increases with weight gain of fat.

In order to avoid wearing a life jacket that states XXL, many women opt to wear a men's vest that states L. Unfortunately, life jackets are not shaped to fit curvy women and as a result, they may appear sloppy and ill-fitting on a breast and easily slide around on the user's body upon impact. Life jackets on women, and particularly larger proportioned women, may be extremely uncomfortable, tight, and breasts may tend to spill out of the arm holes on current life jackets on the market.

The life jacket described herein promotes a fit that is intended to be stylish, functional, comfortable, and flattering, particularly for woman that are curvy and have larger breasts. By fitting better, the life jacket encourages confidence, comfort, and safety so that water sports can be enjoyed to the fullest.

An example body-enhanced life jacket includes a life jacket and an undergarment within the life jacket. In an example, the undergarment is layered within the life jacket. The life jacket may have an outer layer and an inner layer and the undergarment may be positioned in between the two layers. The undergarment may be attached, or removably attached, between the two layers. In another example, the undergarment may be attached, or removably attached, to an interior facing surface of the life jacket.

Figure 1C:
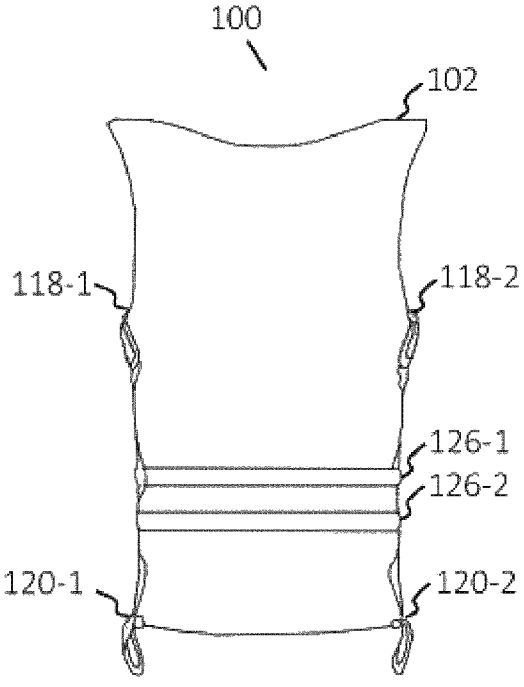
FIG. 1*c* illustrates a back view of a body-enhanced life jacket according to an example of the principles described herein.
Figure 1B:
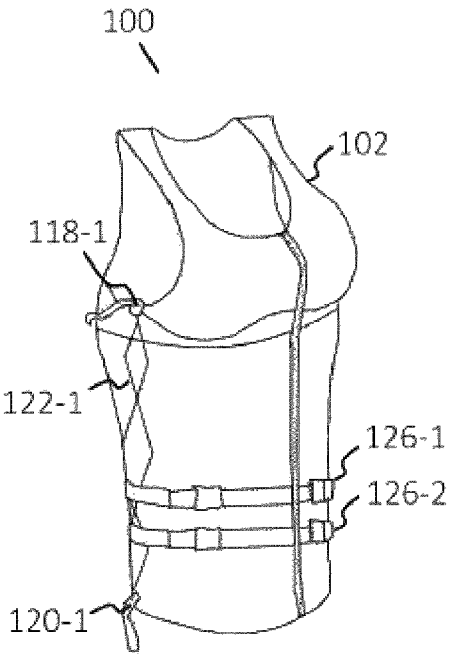
FIG. 1*b* illustrates a perspective view of a body-enhanced life jacket according to an example of the principles described herein.
Figure 1A:
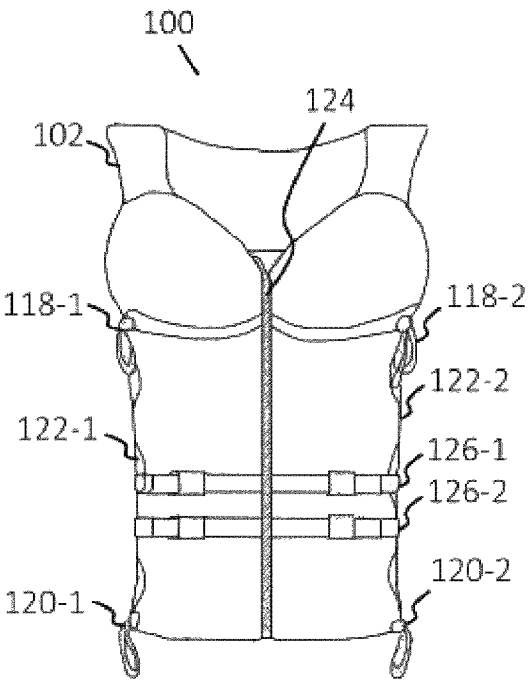
FIG. 1*a* illustrates a front view of a body-enhanced life jacket according to an example of the principles described herein.

Turning to FIGS. 1*a*, 1*b*, and 1*c*, a body-enhanced life jacket 100 is shown that includes a torso encircling garment, such as the vest 102 shown. The vest 102 includes buoyant materials or properties to keep a user afloat in water. The vest 102 may be secured around a user's body with a fastening member 124 such as the zipper shown, or other fastening member that runs vertically or at an angle in the front torso area. As shown, the fastening member 124 is centrally located and extends vertically up and down over the user's torso and chest area. The fastening member 124 may be centrally located as shown or may be off center to the torso area. The fastening member 124 may also be located in other areas to secure the vest 102 around the torso. The body-enhanced life jacket 100 shown includes an undergarment 104 as described below in FIGS. 2*a*, 2*b*.

In an example, the body-enhanced life jacket 100 includes buoyant properties and is designed to allow freedom of movement while providing a user with the necessary life-saving buoyancy. The vest 102 may include buoyant foam pieces or other materials that are layered within the vest 102 to keep the user afloat. In another example, the vest 102 is inflatable. In particular, the body-enhanced life jacket 100 may include a nylon-lined foam material or other material.

Fastening members 124 used to secure the vest 102 around the torso may include at least one of a zipper (as shown), button, hook and loop, tie, snap, buckle, or other device known in the sporting and clothing industry.

The body-enhanced life jacket 100 may further include features or properties that help to define a user's waist, such as the multiple belts 126-1, -2 as shown. The belts shown 126-1, -2 are located in a vertically stacked manner along the user's waist so as to cinch the life jacket 100 at various positions along the user's waist. The belts 126-1, -2 may be positioned so as to define natural or desired contours of the user's body. The belts 126-1, -2 also serve to more fully envelop the user's body so that the life jacket 100 does not slide around on the user's body. This promotes freedom of movement and safety for the user. Foam pieces or other buoyant materials may be strategically placed around the belts 126-1, -2 or other defining features to allow the belts 126-1, -2 to more fully accentuate the user's body contours or desired contours.

The body-enhanced life jacket 100 itself may provide supportive structure—such as molded cups, a shelf, stiff structuring, elastic material, or other features or properties that provide support to a user's breasts. A lacing 122-1, -2 may be used to tighten, loosen, or otherwise adjust supportive structures and thereby adjust the level of support provided to the user's breasts by the supportive structures. As shown, the lacing 122-1, -2 may be on either side of the life jacket and user. In addition to adjusting supportive structure, the lacing 122-1, -2 may be configured to tighten and loosen the vest 102 to conform to natural or desired contours of the user's body.

In the example shown, the lacing 122-1, -2 includes a set of criss-cross laces or straps on either side of the vest 102. In other examples, the lacing is configured to be on the user's back, side, or front region, the lacing criss-crossing as it runs from top down, bottom up, or both top down and bottom up. The lacing 122-1, -2 may cinch the material of the vest 102 together as the free ends of the lacing 122-1, -2 are pulled away from the vest 102. The lacing 122-1, -2 shown begins at or near the armpit region and extends downward toward the bottom of the vest 102 at or near the hip region.

In another example, the lacing 122-1, -2 does not extend the full length of the side of the vest 102. The lacing 122-1, -2, may begin at the armpit region, for example, and extend to the breast region, below the breast region, or to the navel region. In another example, the lacing 122-1, -2 begins at the navel region and extends to the hip region. Other placement is anticipated.

A locking structure 120-1, -2 may be attached to the free end portions of the respective lacings 122-1, -2 to thereby secure the lacings 122-1, -2 to a desired tightness. Also, locking structure 118-1, -2 may be located on sides of the breasts to tighten supportive structures. The locking structure 118-1, -2 may be associated with the lacings 122-1, -2 and the supportive structures. In another example, the locking structure 118-1, -2 is only associated with the supportive structures.

Figure 2A:
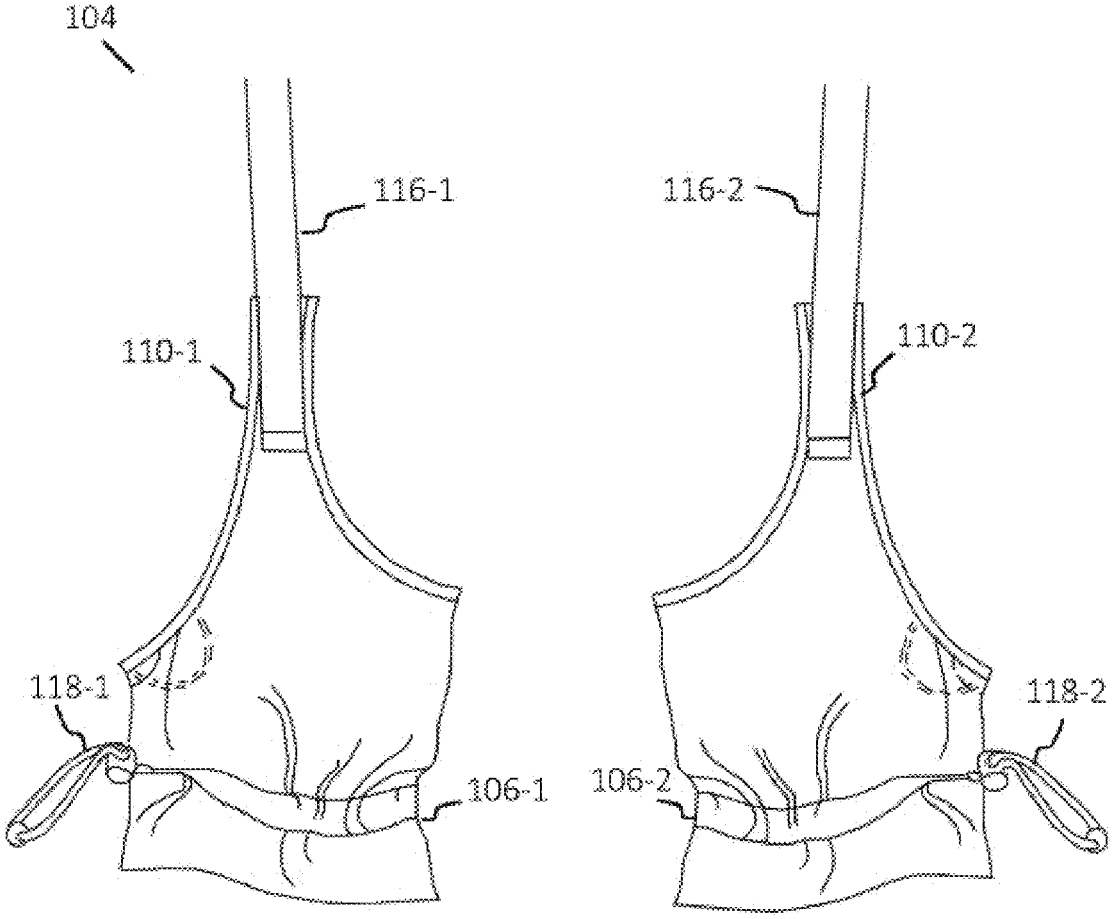
FIG. 2*a* illustrates a right and left panel according to an example of the principles described herein.

Turning to FIG. 2*a*, a supportive structure is shown that includes an undergarment 104 that is attached to the body-enhanced life jacket 100 to support a user's breasts. The undergarment 104 includes a material that is configured to shape and provide support for a user's breasts. The undergarment 104 may be adjustable. In an example, the undergarment 104 may be adjusted in the amount of lift it provides to the user's breasts. In another example, the undergarment 104 is adjusted in its shape around the user's breasts. In another example, the undergarment 104 is adjusted in its shape around the user's breasts. In another example, the undergarment 104 is adjusted in its tightness around the user's breasts. Other adjustments are anticipated, not only for a user's breasts, but also an adjustment to a fit around a user's torso.

The undergarment 104 shown is formed by a right panel 110-1 and a left panel 110-2 that are configured to connect at lateral facing side edges and inner facing side edges of the user. The right 110-1 and left panels 110-2 do not include a back portion to be positioned on the back of the user. Also, straps 116-1, -2 attach the right panel 110-1 and left panel 110-2 to the vest at a shoulder region or over shoulders of the users. At least one of the lateral facing side edges, inner facing side edges, and shoulder portions may be attached to the vest 102. In an example, the right 110-1 and left 110-2 panels are configured to be attached together or otherwise connected at inner or medial facing side edges to provide shape and support for a respective right and left breast.

The undergarment 104 may include shelf support, molded cups, or other supportive structure as previously described. The right 110-1 and left 110-2 panels may be attached to the vest 102 along outer edges, be partially attached along its mutual surface of contact, or fully attached along its mutual surface of contact. In another example, the right 110-1 and left panels 110-2 are at least attached along medial side edges. Attachment of the right 110-1 and left panels 110-2 may be removable from the vest 102 with zippers or insert pockets on the interior of the vest 102. A frontal fastening member, such as frontal fastening member 124, simultaneously fastens right 110-1 and left 110-2 panels as well as the two front medially side edges of the vest 102. In another example, the right 110-1 and left panels 110-2 are attached by separate fastening mechanisms than the two front side edges of the vest 102.

Figure 2B:
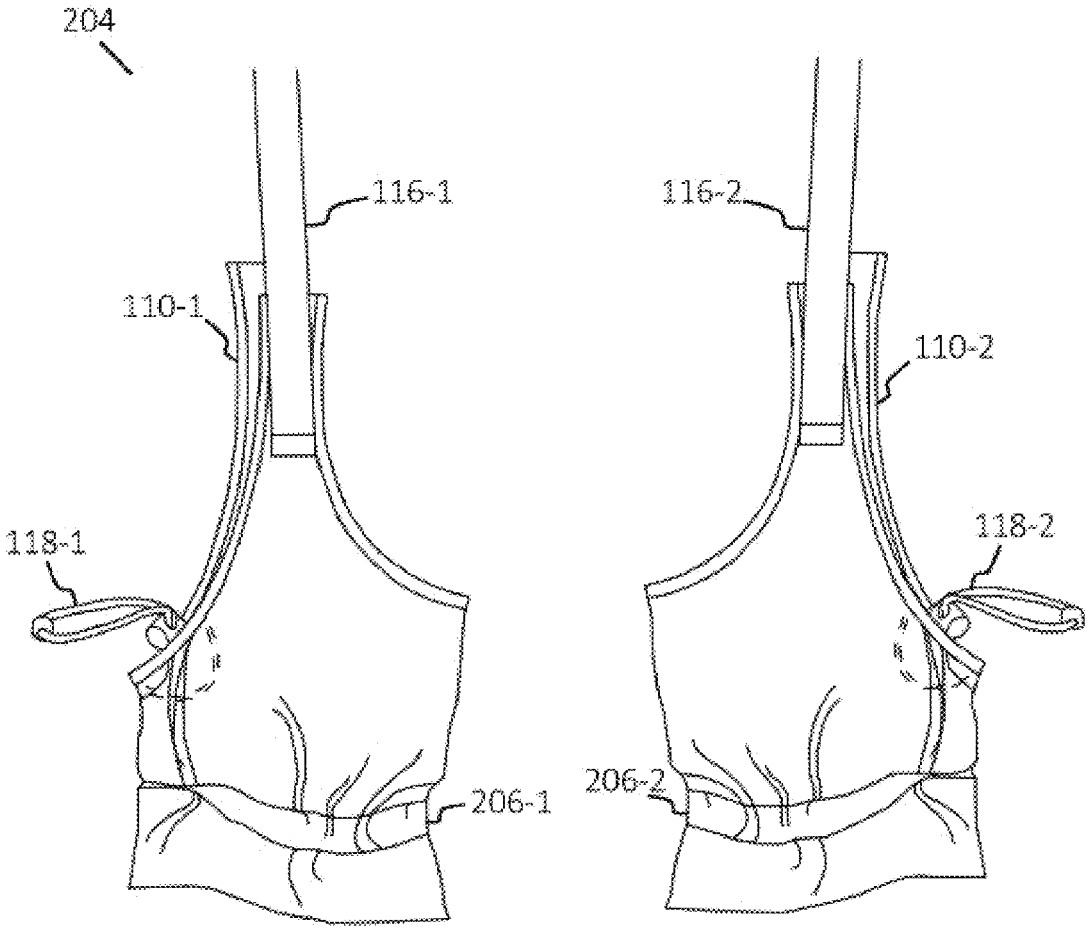
FIG. 2*b* illustrates a right and left panel according to an example of the principles described herein.

At least one adjustable band is attached to at least one of the right 110-1 and left panels 110-2. The right and left adjustable bands 106-1, -2 as shown in FIG. 2*b* are configured to be positioned across the front torso and may be horizontal with respect to the vest 102. As shown, the life jacket 100 includes a right 106-1 and left adjustable band 106-2 that runs along respective bottom lengths of respective right 110-1 and left front panels 110-2 from center chest region to a side region of the user. The right adjustable bands 106-1, -2 have free ends on lateral or outward facing sides of the torso that are at or adjacent to a height of the bottom of the breasts. In other words, the adjustable bands 106-1, -2 are relatively horizontal across the bottom of the breasts. The adjustable bands 106-1, -2 may have a slight curvature under the breasts as shown.

The adjustable bands 106-1, -2 are configured to be tightened and loosened by pulling the free lateral facing ends and securing them at a fixed length to thereby make the respective right 110-1 and left panels 110-2 be more tight or more loose in conforming and supporting the respective right and left breast. The right 106-1 and left adjustable bands 106-2 are adjusted to have a desired length running along the bottom of the chest area, for example, by pulling free ends of the bands radially outward from the sides of the body at or near side edges of the right 110-1 and left panels 110-2. The adjustable bands 106-1 may have rigid or resilient properties. In an example, the adjustable bands include elastic.

A locking structure at a free end portion of each of the right 106-1 and left adjustable bands 106-2 may be used to secure a length for a desired tightness around the respective right and left breast. The right 106-1 and left adjustable bands 106-2 may be held in place by a toggle or other locking structures. As shown, each right 106-1 and left adjustable band 106-2 has a respective toggle 118-1, -2 for a user to easily reach outside of the vest 102. The user pulls the free ends outward to adjust and secure the length of the right 106-1 and left adjustable band 106-2 as desired. In an example, the locking structure is a spring-lock, button, hook, hook and loop, or other locking structure.

FIG. 2*b* illustrates an example of an undergarment 204 in which each right 110-1 and left panel 110-2 includes a front portion and a back portion that are connected at outer or lateral facing side edges that face each other. Straps 116-1, -2 secure the front and back portions of respective right 110-1 and left panels 110-2 over the respective right and left shoulders of the user. Inner or medial facing side edges of the right 110-1 and left panels 110-2 are attached together for securement between the breasts. The right panel 110-1 covers a right front and right back region of the user's right half of the body. The left panel 110-1 covers a left front and back region of the user's left half of the body. The front portions of right 110-1 and left panels 110-2 are configured to extend across a front of a user's torso. The back portions of right 110-1 and left panels 110-2 are configured to extend across a back of a user's torso. Each front panel 110-1, -2 may include a shelf support, molded cup, or other supportive structure as previously described.

As stated, the two front portions of right 110-1 and left -2 panels are removably attached together at lateral side edges and medial facing edges when donning the body-enhanced life jacket 100 to complete the torso encircling undergarment 104. The medial facing side edges of the back portions of right 110-1, and left -2 panels are also attached.

In an example, each of the front and back portions of the right 110-1 and left -2 panels are made up of a single piece of material. The attachments are then the front medial facing side edges and the back medial facing side edges.

Like the undergarment 104 in FIG. 2*a*, the undergarment 204 may include shelf support, molded cups, or other supportive structure as previously described. The right 110-1 and left 110-2 panels may be attached to the vest 102 along outer edges, be partially attached along its mutual surface of contact, or fully attached along its mutual surface of contact. In another example, the right 110-1 and left panels 110-2 are at least attached along medial side edges. Attachment of the right 110-1 and left panels 110-2 may be removable from the vest 102 with zippers or insert pockets on the interior facing side of the vest 102. A frontal fastening member, such as frontal fastening member 124, simultaneously fastens right 110-1 and left 110-2 panels as well as the two front medially side edges of the vest 102. In another example, the right 110-1 and left panels 110-2 are attached by separate fastening mechanisms than the two front side edges of the vest 102.

The two back panels 110-1, -2 may be attached to the vest 102 and to each other. In an example, the two back panels 110-1, -2 are sewn to an interior facing surface of the vest 102 or in between layers of the vest 102. In another example, the two back panels 110-1, -2 are replaced with one back panel. In another example, the two back panels 110-1, -2 are not attached to the vest 102. In another example, attachment of the right 110-1 and left back panels 110-2 may be removable with zippers or insert pockets on the interior side of the vest 102.

The right and left panels are attached to the front of the vest 102 and are tightened across the chest by the adjustable bands 106-1, -2. For example, adjustable bands 206-1, -2 may be positioned across the front torso and include curvature with respect to the vest 102. Particularly, each adjustable band 206-1, -2 follows a natural curve of the breast region, similar to an underwire shape of a bra, and is tightened at respective free ends of the adjustable bands 206-1, -2, which may be positioned at the side of each breast as shown. The free ends may be positioned at the top of the breast region, at or near an armpit, in between the top of the breast region and below the breast or at another anatomical location on the body. The adjustable bands 206-1, -2 are adjustable so that they may be adjusted for tightness across the user's torso and affect at least one of lift of the user's breasts, shape around the user's breasts, shape around the user's torso, or tightness around a torso. In other examples, there is only one adjustable band that is adjusted. Also, the free end of the adjustable band may be located anywhere around the circumference of the user's torso, such as the front, side, or back of the user.

The medial or inner facing free ends of the adjustable bands 206-1, -2 are secured in between the breasts by the fastening member 124, drawing the breasts together. In another example, the medial or inner facing free ends of the adjustable bands 206-1, -2 are not free but are attached to respective edges of front right 110-1 and left 110-2 panels. Securement of the respective medial side edges of front right 110-1 and left 110-2 panels therefore also brings the ends of the adjustable bands 206-1, -2 together in between the breasts.

The free ends of the adjustable bands 206-1, -2 may also be secured between the breasts by another locking means. In an example, the locking means 124 that secures the adjustable bands 206-1, -2 is different than then locking means that secures the two front sides of the vest 102.

In an example, the adjustable bands 206-1, -2 are tightened with medially facing free ends being pulled inward and tightened at a desired length. In another example, the adjustable bands 206-1, -2 are tightened on both free ends at a desired length. In another example, there is only one adjustable band running across the chest and the adjustable band is tightened on lateral free ends. In an example, a single adjustable band encircle the torso and is tightened at the back of the user, for example, at or near the center of the spine directly behind the chest.

Lateral or outer facing free ends of the bands 206-1, -2 are cinched or otherwise tightened and secured to a desired length by locking structure 118-1, -2 and thereby provide the desired adjustment to the user's breasts concerning shape, tightness, lift, etc. Each breast may thereby have a different tightness, allowing for different sized breasts to have a tightness that is appropriate for each breast. Locking structure 118-1, -2 includes toggles as shown, but other types of locking structure 118-1, -2 is anticipated.

In another example, the undergarment 104 includes a set of adjustable bands 106-1, -2 that are tightened at sides of the torso as well as a set of adjustable bands 206-1, -2 that are tightened at sides of the breasts. Adjustable bands may also be tightened at the back. In an example, the adjustable bands meet at free ends at a center of the back around the torso of the user and are tightened at that location. This may be in addition to adjustable bands 106-1, -2, 206-1, -2.

The adjustable bands 106-1, -2 may be attached to the front portions of the right 110-1 and left panels 110-2 and be visible on an interior facing surface of the vest 102. In another example, the adjustable bands 106-1, -2 may be not visible but still be adjusted on the interior facing side. In another example, the adjustable bands 106-1, -2 are adjusted by toggles 118-1, -2 or adjustment devices. In another example, the adjustable bands 106-1, -2 may be layered between an outer layer and inner layer of the vest 102. In another example, the adjustable bands 106-1, -2 are removable.

While the right 110-1 and left panels 110-2 are shown as two separate panels that are attached, other examples are anticipated. For example, the front portions of the right 110-1 and left panels 110-2 may comprise a single contiguous material. In another example, the back portions of the right 110-1 and left panels 110-2 comprise a single contiguous material. Instead of being separable, the right 110-1 and left panels 110-2 may be attached without being removably separated between the breasts, side, or back side. In this manner, the right 110-1 and left panels 110-2 form one single contiguous unit. In another example, the adjustable band 106-1, -2 encircles the entire torso and is positioned generally horizontal with respect to the torso. In another example, the adjustable band 106-1, -2 is actually one band that forms a single contiguous unit around the torso. The lateral sides are cinched or tightened to adjust the form of the breast. In another example, the adjustable band 106-1, -2 encircles the entire torso but also includes curvature underneath the breasts in manner that at least partially or substantially follows the natural curvature underneath the breasts and sides of the breast. A fastening member such as the toggles 118-1, -2 may still be used to tighten or cinch portions of the adjustable band 106-1, -2 on opposing sides of the torso.

In an example, the undergarment 104 comprising the right 110-1 and left panels 110-2 is layered within the materials of the body-enhanced life jacket 100. For example, the body-enhanced life jacket 100 may include an inner layer and an outer layer, or other layers. The undergarment 104 may be layered between the inner and outer layers so as to remain partially or fully concealed during use. The undergarment 104 may be bonded, sewn, or otherwise attached in between the inner and outer layer. The visible portion to the user are the adjustable bands 106-1, -2, 206-1 -2, and the and the toggles 118-1, -2.

In other examples, the undergarment 104 is a visible layer that is at least partially or fully separable from the life jacket 100 itself. Still further, the undergarment 104 may be partially or fully removable from the life jacket 100. In an example, various sized undergarments 102 may be used interchangeably with the life jacket 100. The undergarment 102 may be removably attached from the life jacket 100 at various locations and with various fastening member. This allows women of different size breasts to use the life jacket 100. It also allows the undergarment to be replaced as needed or desired.

In an example, the life jacket may 100 have a sleeve pocket in which the undergarment 104 may be routed to lay positioned within the life jacket 100. The sleeve pocket may be layered within the layers of the life jacket 100 or be an outer pocket that is distinct from the main layers of the life jacket 100. The undergarment 104 may be secured to the life jacket 100 with a locking structure such as at least one zipper, snap, button, slider, tie, magnet, hook and loop, or other locking structure.

The undergarment 104 may include one or more of an underwire, wire free, soft cup, molded cup that eliminate seams, stiffening panels, seaming panels, and padding shaping materials to enhance bust size or cleavage, compression bra, sports bra that minimize movement, push up bra, or encapsulation bra have cups for support. Furthermore, the undergarment 104 may be backless, balconette, convertible, shelf, full cup, demi-cup, minimizing, padded, plunge, posture, push-up, racerback, sheer, strapless, T-shirt, underwire, or unlined.

The undergarment 104 may include one or more components of a bra, such as a chest band, gore (i.e., the section between the cups), back wing (i.e., the section under the armpit where the band joins the cups), side panel, apex, cup, neckline, underwire, strap, ring, slider, strap join, and closure. There may be seaming and stiffening panels to further enhance and support the bust region.

Note that the bands may be attached to the life jacket 100, the undergarment, or both the life jacket and the undergarment. The undergarment 104 or life jacket 100 may provide its own elastic or tightening feature such that it is used instead of or along with the band. A shelf or bra cup or other support may be layered or held within a pocket sleeve of the life jacket. The adjustable band 106-1, -2 may be detached from the shelf or bra cup or other support while also being layered or held within a pocket sleeve within the life jacket 100. Thus, the tightening of the adjustable band 106-1, -2 is disjointed from the actual shelf or bra cup or other support. At least one of the shelf or bra cup or other support or band may be removable.

Figure 3:
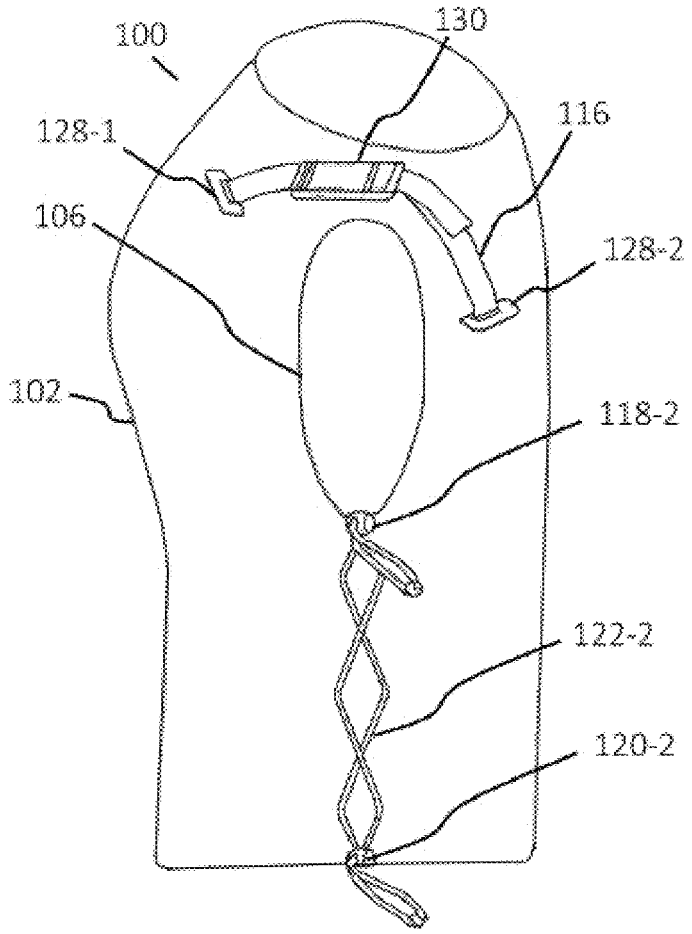
FIG. 3 illustrates a side view of a body-enhanced life jacket according to an example of the principles described herein.

In one example, the shelf or bra or other support includes a shoulder region or strap 130 that connects the front portion to the back portion. Turning to FIG. 3, the life jacket 100 is shown including a shoulder strap 116 that extends over a shoulder region from the front and back portions of the left panel 110-2. The shoulder strap 116 may attach to the front and back portions of the left panel 110-2. In an example, the shoulder strap 116 attaches at free ends to top edges of the front and back portions of the left panel 110-2. In another example, the shoulder strap 116 attaches to a region on the front and back portions of the left panel 110-2. In another example, the shoulder strap 116 attaches to front and back regions of the vest 102 but not the front and back portions of the left panel 110-2. In another example, the shoulder strap 116 attaches to one of the front and back regions of the vest 102 and to one of the front and back regions of the undergarment 104.

The shoulder strap 116 may be adjustable to provide variable lift and tightness on the shoulder region and lift for the breasts by drawing the front and back portions of the left panel 110-2 more tightly together. The shoulder strap 116 may be of a flexible material so that it may conform to the front, back, and shoulder region and be tightened accordingly around the front, back, and shoulder region. The shoulder strap 116 may be resilient or stiff and may comprise elastic.

The shoulder strap 116 may go vertically downward on the back or may angle medially toward the spine at the back to take pressure off the shoulders. As shown, the shoulder strap 116 extends from a location that is at or near a height of the user that is adjacent to an armhole to a top or near a top of the breast region. The shoulder strap 116 may be visible to allow for adjustment. As shown, the shoulder strap 116 visibly extends between openings 128-1 and 128-2 for at least a portion of the shoulder strap 116 to be visible on a top surface of the life jacket 100 along the shoulder region. The shoulder strap 116 may extend an additional length underneath the top layer of the vest 102. The exposed portion may vary in length. For example, the shoulder strap 116 may be exposed only on the front portion or back portion of the vest 102.

Figure 4:
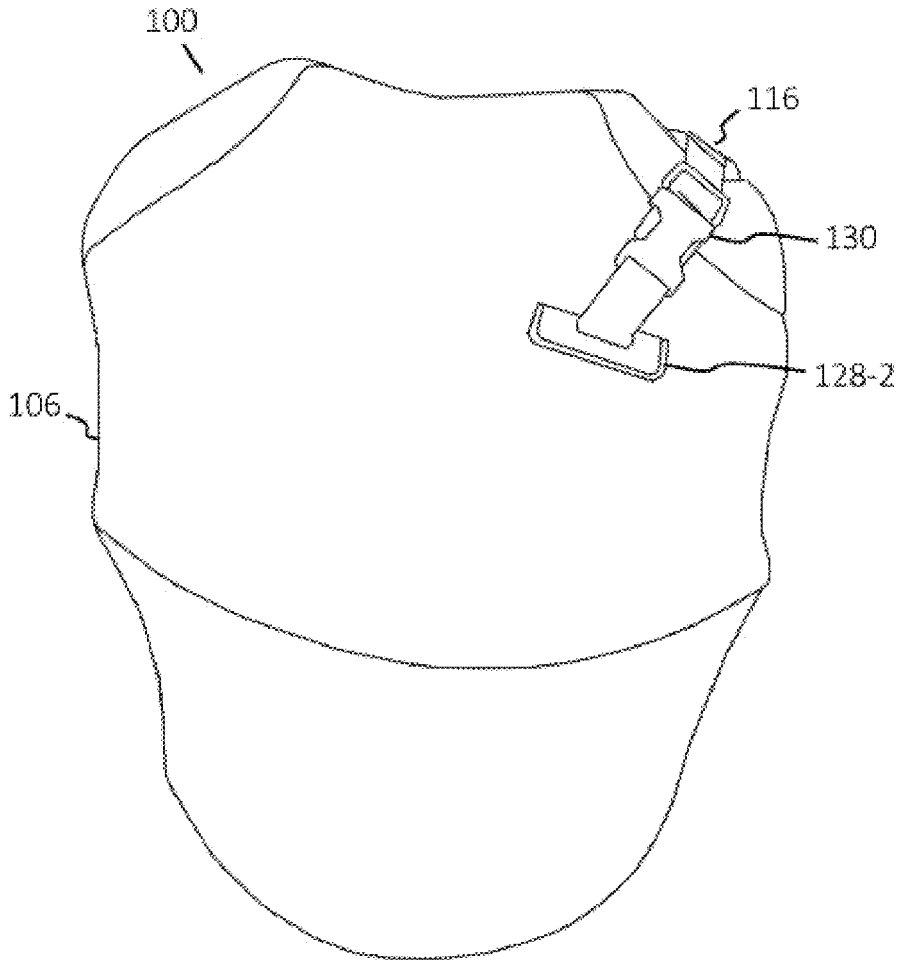
FIG. 4 illustrates a back view of a body-enhanced life jacket according to an example of the principles described herein.

FIG. 4 shows the back of the shoulder strap 116 being angled relative to the back. The angled shoulder strap 116 may provide better support for the breast by applying pressure at a location that is on a shoulder blade in between the spine and the side of the torso.

In an example, two shoulder straps are provided, one for each shoulder. Two shoulder straps may take a variety of forms, including an M-frame or crisscross pattern on the back of the user. Configurations of the shoulder straps and other elements of the undergarment 104 may be designed relative to bony surfaces and landmarks of the torso and upper body, such as the torso, sternum, scapula, ribs, and other bony surfaces and landmarks of a standard anatomical female.

Figure 5:
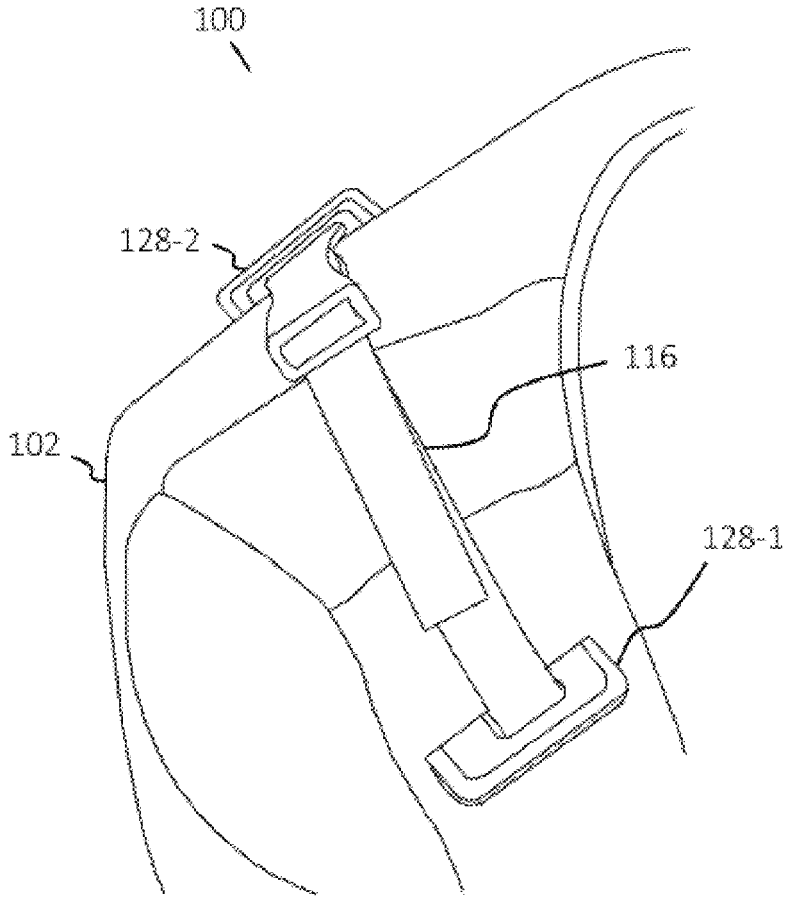
FIG. 5 illustrates a shoulder strap on a body-enhanced life jacket according to an example of the principles described herein.

Turning to FIG. 5, the shoulder strap 116 is shown as being adjustable in length between front and back portions of the vest 102. Adjustment that results include lift of the undergarment 104, and therefore breasts, with a buckle type mechanism 128-2. In other examples, other types of devices may be used to secure the shoulder strap 116, including zippers, buttons, toggles, and other devices.

Figure 6:
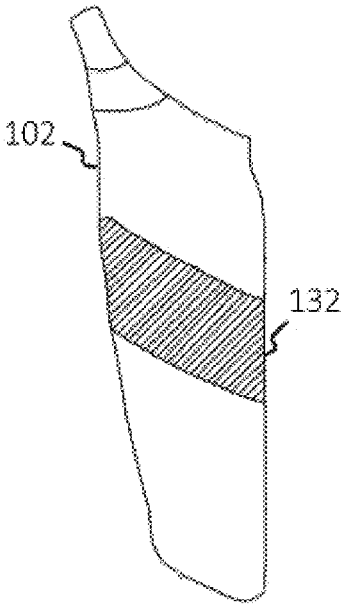
FIG. 6 illustrates a foam piece on a body-enhanced life jacket according to an example of the principles described herein.
Figure 7:
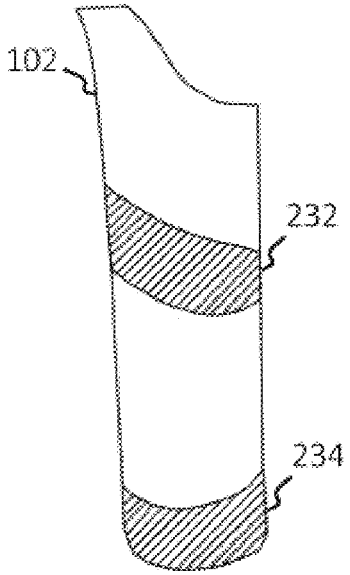
FIG. 7 illustrates a foam piece on a body-enhanced life jacket according to an example of the principles described herein.

FIGS. 6 and 7 illustrate foam pieces that are used in life jackets 100 with the undergarment 104. The foam pieces 132, 232, and 234 may be removable or permanently attached to the life jackets 100. The foam pieces 132, 232, and 234 may be visible or layered within the life jacket 100. The foam pieces 132, 232, and 234 may be attached to the undergarment 104. In an example, the foam pieces 132, 232, 234 are designed to fit underneath the undergarment 104 and not be pressed against breast tissue but still provide buoyancy for the life jacket 100.

FIG. 6 illustrates a foam piece 132 on a right side of a vest 102 that is slanted from at or near a region of the armpit down to the sternum region. Foam piece 232 is also slanted downward from at or near a region of the armpit down to the sternum region, but further includes a cupping shape to conform to the shape of a breast. Foam piece 234 extends along a bottom edge of the vest 102 and may be at or near the bottom edge. Foam pieces 232 and 234 may be narrower than a standard piece of foam on a front of a vest would be. In another example, foam pieces 232 and 234 may be less thick than a standard foam on a vest 102. Together, the foam pieces 232 and 234 may provide the same buoyancy as one standard foam piece that would be on a vest 102. Standard foam pieces may be found in clothing and sporting industries for standard anatomical users. The narrower width divided between two locations on the front of the vest 102 allows for more space for a breast within the framework of the vest 102 and undergarment 104 according to principles discussed herein.

The foam pieces 132, 232, 234 may include cup portions that are removably attached by a locking structure, such as the zipper of the life jacket. The locking structure may be located in the front, sides, or back, etc. The two adjustable bands 106-1, -2 in the front region that run along the front of the chest region, one band running along under each cup portion, may be pulled radially outward to tighten the bust region, as described above. This may leave the foam pieces 132 and 232 untouched and not adjusted relative to the user's body. The two adjustable bands 106-1, -2 may run underneath the breast but above the foam 132 and 232. In an example, the adjustable band 106-1, -2 is directly attached to the foam 132 and 232 such that tightening the adjustable bands 106-1, -2 also tightens the foam pieces 132 and 232 under the breast. With the adjustable band 106-1, -2 tightening the undergarment 104 which is attached to the vest 102, the foam pieces 132 and 232 being attached to the vest 102 may indirectly tighten the foam pieces 132 and 232.

Note that for women of different cup sizes, each band may be pulled to a different tightness. The adjustable bands 106 may be attached directly to the shelf or bra, or attached both directly to the shelf or bra and the life jacket 100.

Points of consideration may include the following:

The jacket may be adjustable. For example, the jacket may be adjusted in size two inches smaller or 2 inches larger. For example, the jacket may be adjusted two inches smaller and 2 inches larger circumferentially around the user's torso. This may be 1 inch or 3 inches or any inches in between.

Lightweight fabric may be used to avoid bulkiness. There may be requirements to fill the fabric with floatable material.

The goal is to produce life jackets for women with larger breasts where they are not tight and do not buckle across the breasts, but still offer support and shape on the breasts. A built-in bra or other support under the outer fabric may be used so as to not be seen.

The vests 102 themselves may be shaped in an hour-glass figure or adjusted to be shaped to be in an hour-glass figure. The length may hit approximately 4 inches below the belly button and sit at the hip. Other examples include different lengths, and below or above hip or other lengths.

When a user dons the vest 102 and then jumps in the water, it may be undesirable for the vest 102 to pull above the ears of the user so that the user has to pull the vest 102 back down around their torso. The customizable cinch sizing principles described herein allow for the vest 102 to form to a user's natural body shape which would eliminate the vest 102 coming over their head when they jump in the water.

Details may include zippers, buckles, fabric, colors, texture, etc., designed to flatter and encourage support and confidence in the user.

Each vest 102 may still allow for pockets and other security features. For example, the vest 102 have a small pocket towards the hip large enough to hold credit card and ID.

In this description, for purposes of explanation, specific details are set forth in order to provide a thorough understanding of the disclosure. It is to be apparent, however, to one skilled in the art that examples consistent with the present disclosure may be practiced without these specific details. Reference in the specification to "an example" or similar language means that a particular feature, structure, or characteristic described in connection with the implementation or example is included in at least that one implementation, but not necessarily in other implementations. The various instances of the phrase "in one implementation" or similar phrases in various places in the specification are not necessarily all referring to the same implementation.

The preceding description has been presented only to illustrate and describe examples of the principles described. This description is not intended to be exhaustive or to limit these principles to any precise form disclosed. Many modifications and variations are possible in light of the above teaching.

What is claimed is:

1. A body-enhanced life jacket comprising:

a life jacket;

an undergarment within the life jacket, the undergarment configured to shape and provide support for a user's breasts;

a front panel;

a back panel;

a right adjustable band and a left adjustable band, wherein the right adjustable band and the left adjustable band are attached together at the free ends underneath each of the two breast regions between the user's breasts; and the right adjustable band attached to the undergarment to be underneath a user's right breast region, the left adjustable band attached to the undergarment to be underneath a users's left breast region, the right adjustable band and the left adjustable band configured to run partially or fully circumferentially around the user's torso, the right adjustable band of the front and back panels being adjustable so that it may be adjusted for tightness across the user's torso and affect at least one of lift of the user's breasts, shape around the user's breasts, shape around the user's torso, or tightness around a torso, the left adjustable band of the front and back panels being adjustable so that it may be adjusted for tightness across the user's torso and affect at least one of lift of the user's breasts, shape around the user's breasts, shape around the user's torso, or tightness around a torso.

2. The body-enhanced life jacket in claim 1, the undergarment comprising:

a right and left panel forming a torso encircling undergarment, each of the right and left panels including a front portion and a back portion.

3. The body-enhanced life jacket in claim 2, wherein the right panel and the left panel are attached at back facing edges, lateral or outer side edges of the right and left panels, or at corresponding top edges of the right and left panels, the right and left panels to be removably attached at or near a region between the breasts.

4. The body-enhanced life jacket in claim 3, wherein a locking structure includes a toggle, spring-lock, button, or hook.

5. The body-enhanced life jacket in claim 2, wherein a portion of the right panel is configured to provide shape and support for a right breast, and a portion of the left panel is configured to provide a shape and support for a left breast.

6. The body-enhanced life jacket in claim 1, further comprising a frontal fastening member that removably fastens right and left front portions of respective right and left panels together at a front center of the user's chest area.

7. The body-enhanced life jacket in claim 1, wherein a frontal fastening member is a zipper.

8. The body-enhanced life jacket in claim 1, further comprising a locking structure at a free end portion of each of the right and left adjustable bands that is used to secure a tightness of the respective right and left breast.

9. The body-enhanced life jacket in claim 1, the life jacket further comprising at least one lacing configured to run from top down, bottom up, or both top down and bottom up, the lacing to be tightened to make the life jacket conform to natural or desired contours of the user's body, the lacing to be loosed to make the life jacket be less conforming to natural or desired contours of the user's body.

10. The body-enhanced life jacket in claim 1, the life jacket further comprising a right and left support that is secured together by a common locking structure with the right and left panel over a front region of the user's body.

11. The body-enhanced life jacket in claim 1, the life jacket further comprising a right and left portion that is simultaneously secured together with the right and left panel by a common locking structure.

12. The body-enhanced life jacket in claim 1, wherein the undergarment is removable from the life jacket.

13. The body-enhanced life jacket in claim 1, further comprising a foam piece that is positioned below a breast on the life jacket and that defines a curvature or cupping shape of a bottom of a breast.

14. The body-enhanced life jacket in claim 1, further comprising shoulder straps that are attached to respective front portions and back portions of the right panel and the left panel, the shoulder straps to be tightened and loosened as desired to support the breasts.

15. The body-enhanced life jacket in claim 1, wherein the shoulder strap is angled from the shoulder to the back of the spine to alleviate pressure from the breast on the shoulder.

16. The body-enhanced life jacket of claim 1, wherein the undergarment within the life jacket is positioned between and inner layer and an outer layer.

17. The body-enhanced life jacket of claim 1, wherein the undergarment may be attached, or removable attached, to an interior facing surface of the life jacket.

18. A body-enhanced life jacket comprising:

a life jacket;

a right adjustable band;

a left adjustable band;

a shoulder strap that forms an angled pattern on a back of the user;

an undergarment within the life jacket having a right and left panel with front and back portions, the undergarment configured to shape and provide support for a user's breasts; and the right adjustable band attached to the undergarment and that runs along the bottom length of the right panel and the left adjustable band that runs along the bottom length of the left panel from center chest region to a side region, wherein the right adjustable band and the left adjustable band are attachable together at free ends in a front area underneath each of the two breast regions between the user's breasts, the right adjustable band and the left adjustable band configured to be tightened and loosened to thereby make the respective right and left front portions of right and left panels be more tight or more loose in conforming and supporting the respective right and left breast.

19. The body-enhancing life jacket of claim 18, wherein at least one belt is vertically stacked and a foam piece may be strategically placed around the belt to more fully accentuate a user's body contours or desired counters.

20. A body-enhancing life jacket comprising:

a life jacket;

a right adjustable band;

a left adjustable band;

an undergarment within the life jacket having a right and left paned with front and back portions, the undergarment configured to shape and provide support for a user's breasts;

the right adjustable band attached to the undergarment and that runs along the bottom length of the right panel and lift adjustable band that runs along the bottom length of the left panel from the center chest region to a side region, the right adjustable band and the left adjustable ban configured to be tightened and loosened to thereby make the respective right and left front portions of right and left panels be more tight or more loose in conforming and supporting the respective right and left breast; and a foam piece is positioned below a breast on the life jacket and defines a curature or cupping shape of a bottom of a breast, and the foam piece is removable.

* * * * *